US006926209B2

(12) United States Patent
Cannon

(10) Patent No.: US 6,926,209 B2
(45) Date of Patent: Aug. 9, 2005

(54) DEVICE FOR CLEANING AND MAINTENANCE OF COOLING FINS OF HEAT EXCHANGER OF AN AIR CONDITIONER

(76) Inventor: Alexis Alie Ladislaw Cannon, 4170 NE. 11 Ave., Pompano Beach, FL (US) 33064

( * ) Notice: Subject to any disclaimer, the term of this patent is extended or adjusted under 35 U.S.C. 154(b) by 133 days.

(21) Appl. No.: 10/457,799

(22) Filed: Jun. 9, 2003

(65) Prior Publication Data

US 2004/0256492 A1 Dec. 23, 2004

(51) Int. Cl.[7] ..... B05B 9/06; B05B 7/02; B05B 9/01; A62C 2/08

(52) U.S. Cl. ..... 239/100; 239/525; 239/526; 239/532; 239/530; 239/280; 239/548

(58) Field of Search ..... 239/100, 525, 239/532, 530, 526, 280, 548, 565, 566, 600

(56) References Cited

U.S. PATENT DOCUMENTS 4,083,495 A * 4/1978 Sharp ..... 239/754
4,095,746 A * 6/1978 Anderberg et al. ..... 239/754
4,930,706 A * 6/1990 Merlin ..... 239/754
5,653,392 A * 8/1997 Wells ..... 239/722
6,378,791 B1 * 4/2002 Perry et al. ..... 239/532

* cited by examiner

*Primary Examiner*—Davis Hwu
(74) *Attorney, Agent, or Firm*—M. K. Silverman

(57) ABSTRACT

A device for the cleaning and maintenance of the cooling fins of a heat exchanger of an air conditioner unit includes a pistol-grip water nozzle having a water inlet providing a water pressure of between about 40 to about 80 pounds per square inch (about 300 cm Hg), the nozzle having a threaded outlet. The device also includes a hose adapter proportioned for securement to the nozzle outlet, the adapter having an outlet proportioned for receipt of a threaded inlet. Central to the inventive device is an elongate segment of cylindrical tubing having the threaded inlet as its inlet. The tubing segment includes a virtual vertical plane of symmetry defining respective left and right hollow semi-cylinders of the tubing, an outer lateral side of one of the semi-cylinders having an axial sequence of apertures in a line defining a right angle to the plane of symmetry, each having a diameter of between about 0.3 and about 0.6 millimeters and having respective axial separations of between about 4 and about 9 millimeters. The elongate segment of tubing is about 51 centimeters long and includes an end cap sealing and outlet thereof.

24 Claims, 6 Drawing Sheets

DEVICE FOR CLEANING AND MAINTENANCE OF COOLING FINS OF HEAT EXCHANGER OF AN AIR CONDITIONER

BACKGROUND OF THE INVENTION

1. Area of Invention

The present invention relates to an article for the cleaning of fins of a heat exchanger.

2. Prior Art

A need has long existed for a means for the removal of dirt, dust and oil from and between the cooling fins of a heat exchanger of an air conditioner. Due to the small dimension which exists between cooling fins, typically on the order of one millimeter, the cleaning of such cooling fins has always been a troublesome chore for air conditioning professionals as well as home owners wishing to properly maintain their air conditioning equipment.

At present, the cleaning of the air handler of an air conditioner typically involves the removal thereof from its housing and, thereafter, the use of a high pressure water hose at close range to dislodge dirt, dust, insects, oil, and other unwanted material which, over time, will inevitably accumulate between the cooling fins of the heat exchanger.

In the prior art, there is not known any simple or economical device or means to effect such cleaning of the cooling fins of an air conditioning system. See, for example, U.S. Pat. No. 5,507,972 to Akazawa. Accordingly, the present invention responds to a long-felt need in the art in the area of air conditioning.

SUMMARY OF THE INVENTION

A device for the cleaning and maintenance of the cooling fins of a heat exchanger of an air conditioner unit includes a pistol-grip water nozzle having a water inlet providing a water pressure of between about 40 to about 80 pounds per square inch, said nozzle having a threaded outlet. The device also includes a hose adapter proportioned for securement to said nozzle outlet, the adapter having an outlet proportioned for receipt of a threaded inlet. Central to the inventive device is an elongate segment of cylindrical tubing having said threaded inlet as the inlet thereof. Said tubing segment includes a virtual vertical plane of symmetry defining respective left and right hollow semi-cylinders of said tubing, an outer lateral side of one of said semi-cylinders having therein an axial sequence of apertures at a right angle to said plane of symmetry, each having a diameter of between about 0.3 and about 0.6 millimeters and having respective axial separations of between about 4 and about 9 millimeters. Said elongate segment of tubing is about 51 centimeters long and includes an end cap sealing the outlet thereof.

It is an object of the present invention to provide a convenient and cost-effective device for the cleaning and maintenance of cooling fins of a handler of a heat exchanger of an air conditioning system.

It is another object to provide a device of the above type that may be used for the cleaning of said cooling fins whether or not the exchanger is removed from its housing.

It is a further object of the invention to provide a device of the above type which is functional either co-axially with the direction of water input or transversely thereto.

It is a still further object to provide a device that may be employed using a standard piston grip water nozzle of a garden hose.

The above and yet other objects and advantages of the present invention will become apparent from the hereinafter set forth Brief Description of the Drawings, Detailed Description of the Invention and claims appended herewith.

DETAILED DESCRIPTION OF THE INVENTION

Figure 1:
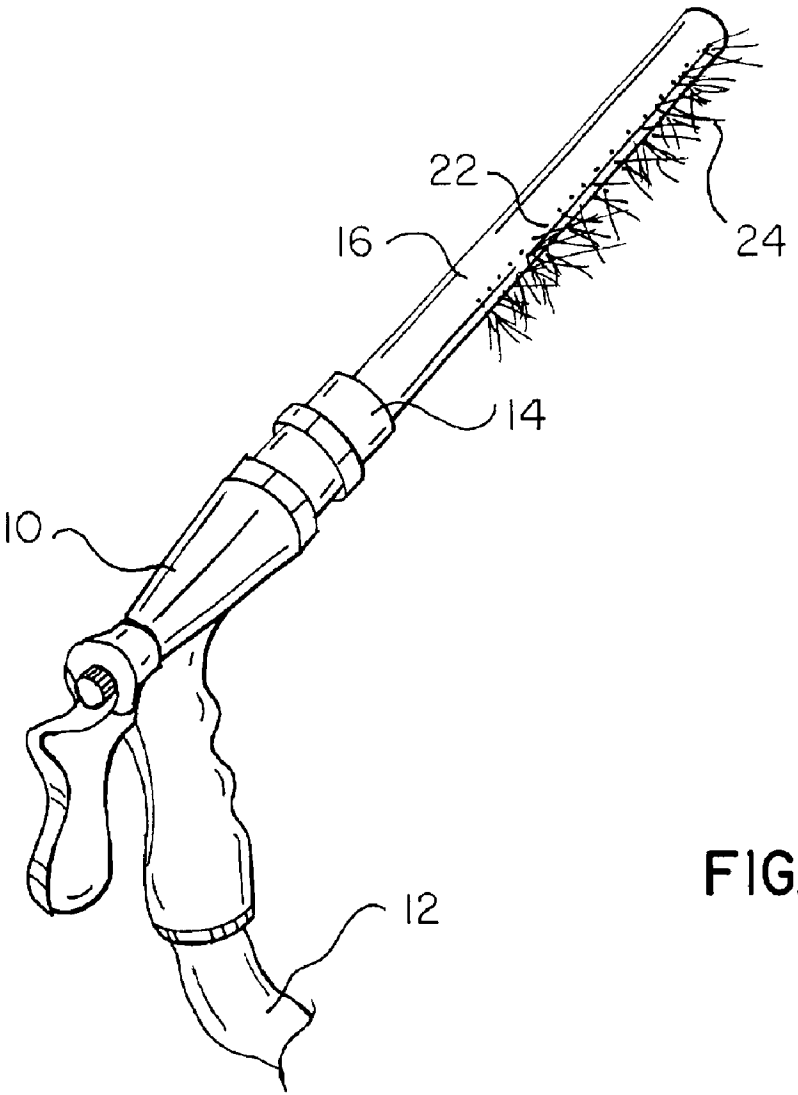
FIG. 1 is a perspective view of a first embodiment of the inventive system.

With regard to the perspective view of FIG. 1, a first embodiment of the device for the cleaning and maintenance of cooling fins of a heat exchanger of an air conditioning unit may be seen to include a pistol-grip water nozzle 10 having a water inlet 12 which provides in input of tap water at a pressure in a range of about 40 to about 80 pounds per square inch (about 300 Hg).

Figure 2:
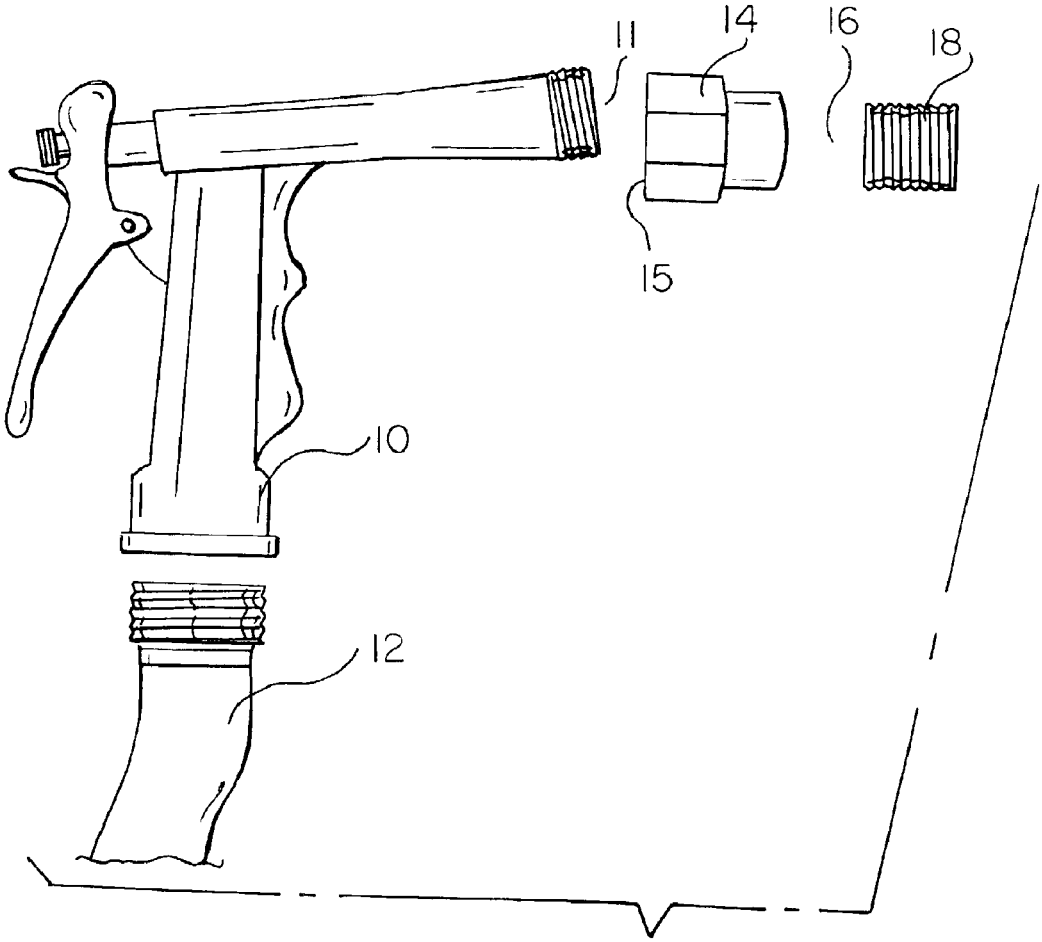
FIG. 2 is an exploded view of the pistol-grip water nozzle, hose adapter and inlet of the elongate tubing segment of the present invention.

Downstream of water nozzle 10 is a hose adapter 14 which is proportioned for securement to nozzle outlet 11. As may be noted in FIG. 2, an inlet 15 of hose adapter 14 is proportioned for receipt of said threaded outlet 11 of the water nozzle 10.

Figure 3:
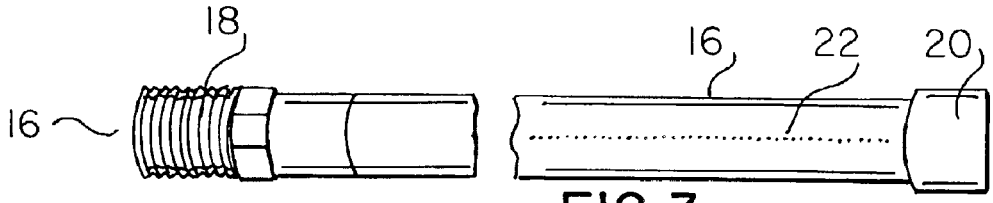
FIG. 3 is a fragmentary view of the elongate cylindrical tubing segment associated with the view of FIG. 2.
Figure 4:
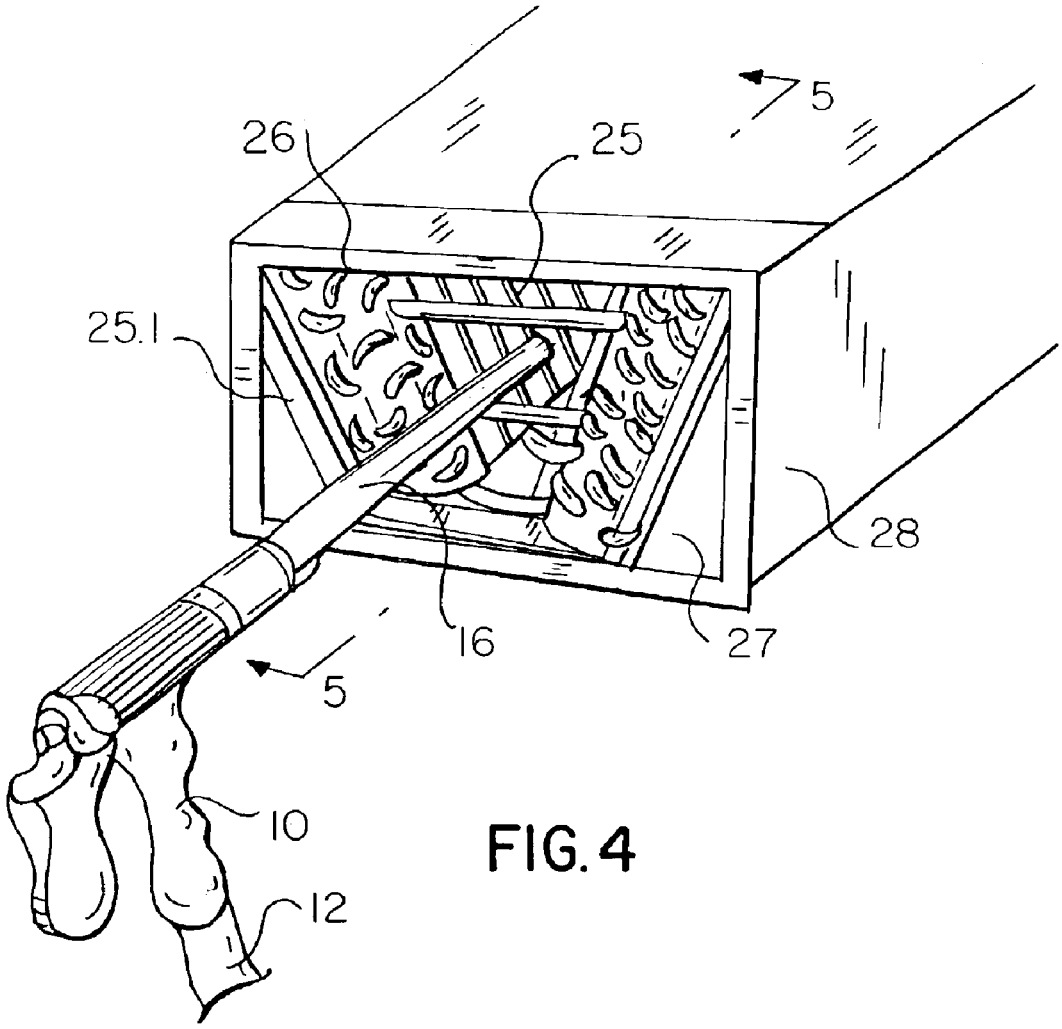
FIG. 4 is an operational view showing the use of the embodiment of FIGS. 1–3.
Figure 5:
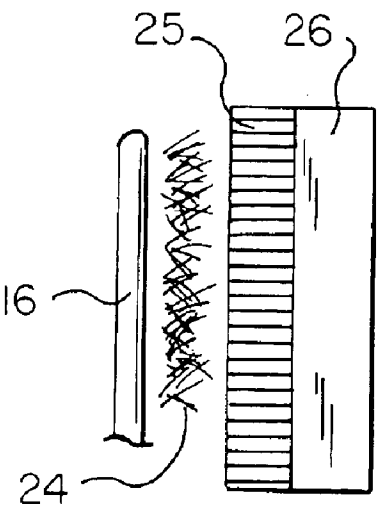
FIG. 5 is a horizontal top cross-sectional view taken along plane 5—5 of FIG. 4.
Figure 8:
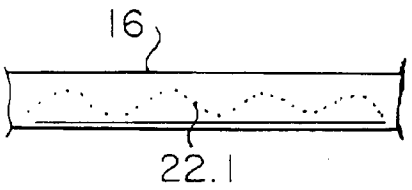
FIG. 8 is a plan view of the elongate segment of cylindrical tubing in which the axial sequence of apertures provided upon the outer lateral side of one semi-cylinder of the tubing is a non-linear pattern.

Downstream of adapter 14 is an elongate segment of cylindrical tubing 16 which, typically, will comprise conventional copper tubing of a type used by plumbers. As may be noted in FIGS. 2 and 3. said tubing includes an inlet 16 having a threaded portion 18 thereof. Further, tubing segment 18 extends for a length in a range of about 18 to about 20 inches (about 48 to about 54 centimeters) and ends with an end cap 20 which seals the cutlet of tubing segment 16. Positioned in an axial sequence along an outer lateral side of one semi-cylinder of said tubing, defined by an intersection of a virtual vertical plane of symmetry through the center thereof and at a plane substantially a right angle to such plane of symmetry. As may be noted in FIGS. 3 and 9, apertures 22 and 22.1 may be respectively linear or may assume other patterns such as the sinusoid shown in FIG. 8 It Is also to be appreciated that multiple rows of the axial sequence of apertures may be employed if sufficient water inlet pressure is available. The apertures are separated from each other by between about 4 and about 9 millimeters and each is provided with a diameter in a range of about 0.3 to about 0.6 millimeters. It has been discovered that the use of such small diameter apertures in combination with a water pressure of between 40 and 80 (typically, 50 pounds per square inch) will result in a high pressure needle-like spray 24 from the apertures 22 which, at a separation of between about 4 and about 9 millimeters. will effectively penetrate fin structure 25 (see FIG. 4) of a heat exchanger 26. In FIG. 4 is shown the use of the invention of the embodiment of FIGS. 1–3 with the exchanger disposed within a housing 28 thereof after the front panel of the exchanger has been removed. As may be noted in the internal plan view of FIG. 5, spray 24 of apertures 22 impact upon cooling fins 25 of the heat exchanger 26. Because of the high pressure associated with spray 24; dust, dirt, insects, oil and other material which may have become embedded within internal fins 25 will be quickly dislodged. It Is however to be noted that much of the cleaning is done on external fins 25.1 which are accessed at region 27 where the air is sucked in and most of the accumulation of oil and dirt occurs.

It is noted that adapter 14 may be incorporated into the inlet 16 of tubing 18, as a single integral piece.

Figure 6:
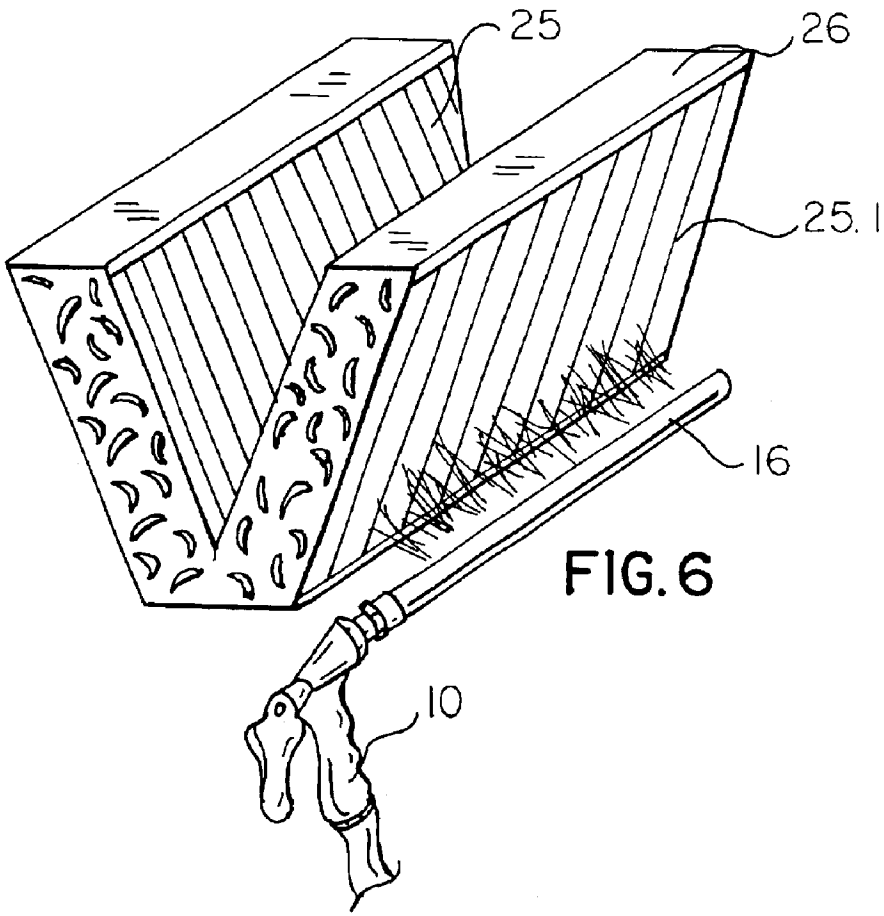
FIG. 6 is an operational view showing the use of the embodiment of FIG. 1 in the cleaning of the fins of a heat exchanger that has been removed from its housing.

In FIG. 6 is shown use of the present invention where exchanger 26 is, optionally, removed from housing 28 thereof, so that the external fins 25.1 may be readily accessed and cleaned.

Figure 7:
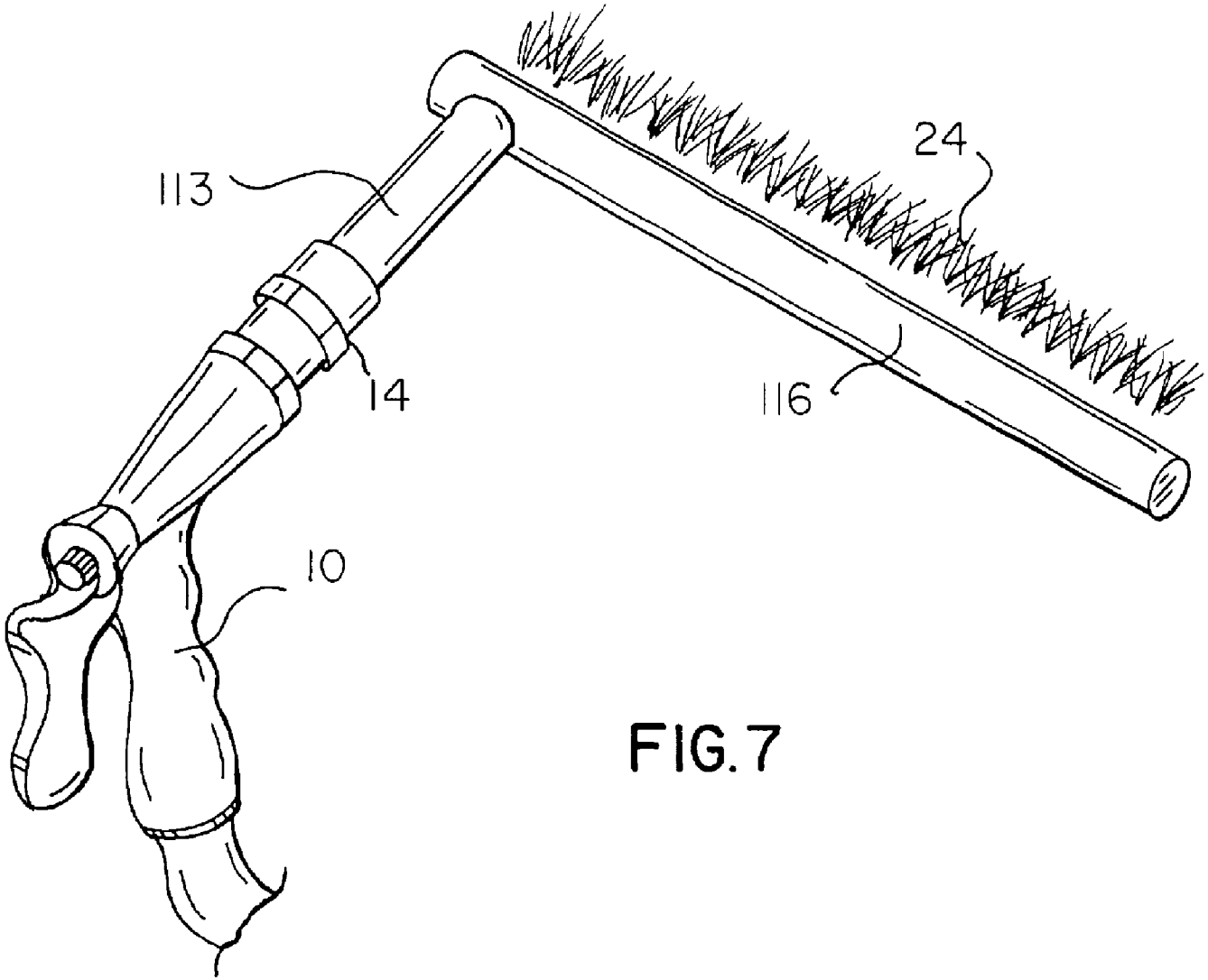
FIG. 7 is a perspective view of a second embodiment of the invention.

In FIG. 7 is shown a further embodiment of the invention in which elongate segment 16 of the embodiment of FIGS. 1–6 is replaced by a first portion 113 and a second portion 116 which is constructed and which functions in the manner above-described with respect to elongate segment 16 in the prior embodiment. Therefore, hose adapter 14 is fluidly secured to first portion 113 which in turn is in fluid communication with a second portion 116, having a length of at least 30 cm. The geometry of the embodiment of FIG. 7 is of value in reaching the fins of the heat exchanger having geometries other than that shown in FIGS. 4 and 6 or which are positioned in a manner in which the embodiment of FIGS. 1–6 would be more difficult to employ.

Figure 9:
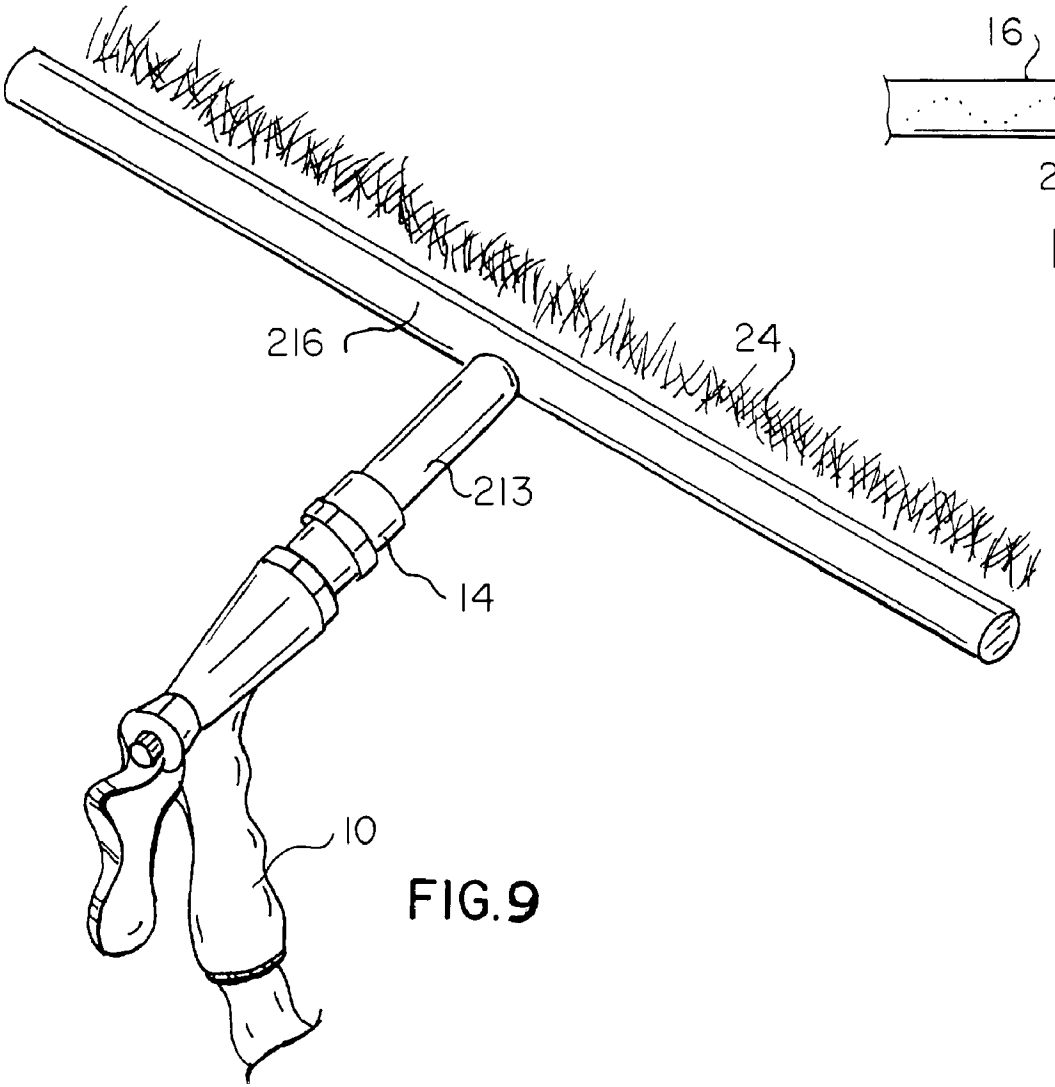
FIG. 9 is a perspective view of a third embodiment thereof.

In FIG. 9 is shown a further embodiment of the invention in which there exists a T-like relationship between second portion 216 and first portion 213 of the elongate segment of tubing of the instant invention. The geometry of the embodiment of FIG. 9 is of value in the cleaning of air conditioners having yet other geometries and orientations. As in the embodiment of FIGS. 1–6, the length of second segment 116 is preferably in a range of 48 to 54 centimeters as is each arm of second portion 216 of the embodiment of FIG. 9.

The efficiency of the cleaning process may be enhanced through the use of an additive, known as a pre-spot, the function of which is to dissolve oil. Accordingly, since much of the dirt and debris which gather within cooling fins of air handlers originates with oil, it is useful to add to the fluid flow such a pre-spot additive.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

I claim:

1. A device for the cleaning and maintenance of cooling fins of a heat exchanger of an air conditioner handler, the device comprising:

(a) a pistol-grip water nozzle having a water inlet at a pressure in a range of about 40 to about 80 pounds per square inch (200 to 400 cm Hg), and having a threaded outlet thereof;

(b) a hose adapter proportioned for securement to said nozzle outlet, said adapter having an outlet proportioned for receipt of a threaded inlet;

(c) an elongate segment of cylindrical tubing having a threaded inlet complemental to said outlet of said hose adapter, said tubing segment including a virtual vertical plane of symmetry defining respective elongate left and right hollow semi-cylinders of said tubing, an outer lateral side of one of said semi-cylinders having therein at least one axial sequence of apertures, each aperture having a diameter of between about 0.3 and about 0.6 millimeters and having respective axial separations of between about 4 and about 9 millimeters; and (d) an end cap comprising means for sealing an outlet of said tubing.

2. The device as recited in claim 1, in which said tubing comprises a diameter between about 10 and about 16 millimeters.

3. The device as recited in claim 1, in which said axial sequence of apertures comprises a linear sequence thereof.

4. The device as recited in claim 3, in which said axial sequence of apertures are positioned upon a virtual line defined by an intersection of (i) an horizontal plane projecting normally from said vertical plane of symmetry from a longitudinal axis of said tubing; and (ii) one of said semi-cylinders of said tubing.

5. The device as recited in claim 1, in which said tubing comprises copper pipe.

6. The device as recited in claim 1, in which said segment of tubing comprises:

a first portion having an axis co-linear with an axis of said outlet of said hose adapter, and a second portion in fluid communication with said first portion having an axis thereof substantially normal to said axis of said first portion, said second portion including said axial sequence of apertures.

7. The device as recited in claim 6, in which said tubing comprises a diameter between about 10 and about 16 millimeters.

8. The device as recited in claim 6 in which said tubing comprises a diameter between about 10 and about 16 millimeters.

9. The device as recited in claim 6, in which said axial sequence of apertures comprises a linear sequence thereof.

10. The device as recited in claim 8, in which said axial sequence of apertures are positioned upon a virtual line defined by an intersection of (i) an horizontal plane projecting normally from said vertical plane of symmetry from a longitudinal axis of said tubing; and (ii) one of said semi-cylinders of said tubing.

11. The device as recited in claim 6, in which said tubing comprises copper pipe.

12. The device as recited in claim 6, in which said respective first and second portions define an L-shaped connection.

13. The device as recited in claim 6, in which said respective first and second portions define a T-shaped connection.

14. The device as recited in claim 1, in which said elongate segment comprises a length of between about 48 and about 54 centimeters.

15. The device as recited in claim 14, in which said sequence of apertures begins about 15 cm after said hose adapter.

16. A device for the cleaning and maintenance of cooling fins of a heat exchanger of an air conditioner handler, the device comprising:

(a) a pistol-grip water nozzle having a water inlet at a pressure in a range of about 40 to about 80 pounds per square inch (200 to 400 cm Hg), and having an outlet thereof;

(b) an elongate segment of cylindrical tubing having a threaded inlet complemental to said outlet of said hose nozzle, said tubing segment including a virtual vertical plane of symmetry defining respective elongate left and right hollow semi-cylinders of said tubing, an outer lateral side of one of said semi-cylinders having therein at least one axial sequence of apertures, each aperture having a diameter of between about 0.3 and about 0.6 millimeters and having respective axial separations of between about 4 and about 9 millimeters; and (c) an end cap comprising means for sealing an outlet of said tubing.

17. The device as recited in claim 16, in which said tubing comprises a diameter between about 10 and about 16 millimeters.

18. The device as recited in claim 17, in which said axial sequence of apertures comprises a linear sequence thereof.

19. The device as recited in claim 18, in which said axial sequence of apertures are positioned upon a virtual line defined by an intersection of (i) an horizontal plane projecting normally from said vertical plane of symmetry from a longitudinal axis of said tubing; and (ii) one of said semi-cylinders of said tubing.

20. The device as recited in claim 16, in which said tubing comprises copper pipe.

21. The device as recited in claim 16, in which said segment of tubing comprises:

a first portion having an axis co-linear with an axis of said outlet of said water nozzle; and a second portion in fluid communication with said first portion having an axis thereof substantially normal to said axis of said first portion, said second portion including said axial sequence of apertures.

22. The device as recited in claim 19, in which said segment of tubing comprises a diameter between about 10 and about 16 millimeters.

23. The device as recited in claim 20, in which said segment of tubing comprises a diameter between about 10 and about 16 millimeters.

24. The device as recited in claim 21, in which said axial sequence of apertures comprises a linear sequence thereof.

* * * * *